US007000851B2

(12) United States Patent
O'Brien et al.

(10) Patent No.: US 7,000,851 B2
(45) Date of Patent: Feb. 21, 2006

(54) INTEGRATED INJECTION LINE AND INJECTION NOZZLE

(75) Inventors: Michael J. O'Brien, Glastonbury, CT (US); Robert W. Martin, Jr., Windsor, CT (US); Kenneth H. Klopfer, East Hartland, CT (US)

(73) Assignee: Stanadyne Corporation, Windsor, CT (US)

( * ) Notice: Subject to any disclaimer, the term of this patent is extended or adjusted under 35 U.S.C. 154(b) by 0 days.

(21) Appl. No.: 10/489,105

(22) PCT Filed: Mar. 19, 2003

(86) PCT No.: PCT/US03/08572

§ 371 (c)(1),
(2), (4) Date: Mar. 9, 2004

(87) PCT Pub. No.: WO03/081017

PCT Pub. Date: Oct. 2, 2003

(65) Prior Publication Data

US 2004/0251322 A1 Dec. 16, 2004

Related U.S. Application Data

(60) Provisional application No. 60/366,054, filed on Mar. 19, 2002.

(51) Int. Cl.

| | |
|---|---|
| ***F02D 1/06*** | (2006.01) |
| ***F02M 59/00*** | (2006.01) |
| ***F02M 39/00*** | (2006.01) |
| ***F02M 47/02*** | (2006.01) |

(52) U.S. Cl. ..... 239/5; 239/533.2; 239/533.3; 239/88; 239/93; 239/95; 239/533.1

(58) Field of Classification Search ..... 239/533.2–533.12, 96, 88–93, 94, 95, 97, 239/533.1, 5

See application file for complete search history.

(56) References Cited

U.S. PATENT DOCUMENTS

| | | | | |
|---|---|---|---|---|
| T983,006 | I4 | 6/1979 | Bailey et al. | |
| 4,765,543 | A | 8/1988 | Jaksa et al. | |
| 5,110,054 | A | 5/1992 | Stevens | |
| 5,692,723 | A * | 12/1997 | Baxter et al. | 251/129.21 |
| 6,260,537 | B1 * | 7/2001 | Lamb et al. | 123/456 |

OTHER PUBLICATIONS

International Search Report PCT/US03/08572, dated Aug. 4, 2003.

* cited by examiner

*Primary Examiner*—Davis Hwu
(74) *Attorney, Agent, or Firm*—Alix, Yale & Ristas, LLP

(57) ABSTRACT

Fuel injector having a sleeve-shaped connector (22), injection nozzle (12) and injection line (14).

12 Claims, 3 Drawing Sheets

INTEGRATED INJECTION LINE AND INJECTION NOZZLE

CROSS-REFERENCE TO RELATED APPLICATIONS

This is the national stage of International Application No. PCT/US03/08572 filed Mar. 19, 2003 which claims the benefit of 60/366,054, filed Mar. 19, 2002.

BACKGROUND OF THE INVENTION

This invention relates generally to vehicle fuel delivery systems. More particularly, the present invention relates to the injection nozzle and injection line providing fluid communication between an injection pump and the injection nozzle of a vehicle fuel injection system.

In conventional vehicle fuel injection systems, the injection pump, nozzle and injection line are separate components, with the injection line connecting the top portion of the injection pump to the top portion of the nozzle. As well might be imagined, the connections between the three components may leak, possibly resulting in reduced fuel injection system reliability. Also, the top-mounting location of the injection line to the pump and nozzle imposes engine cylinder head space requirements which can make it difficult to locate the engine in the engine compartment or which can impose design limitations on styling of the vehicle. In addition, the nozzle body must have sufficient mass to provide for machined fuel passages between the top-mounted injection line and the valve chamber of the injection nozzle.

SUMMARY OF THE INVENTION

Briefly stated, the invention in a preferred form is an integrated injection line and nozzle for a vehicle fuel injection system which includes a tubular injection line having a proximal end portion and a passage extending from the proximal end to the distal end. A sleeve-shaped connector includes inner and outer surfaces and an opening extending from the inner surface to the outer surface. An injection nozzle includes a longitudinal bore and a body portion having an outer surface and an opening extending from the longitudinal bore to the outer surface. The outer surface has a cross-sectional shape which is complementary to the cross-sectional shape of the inner surface of the connector. The body portion of the nozzle is disposed within the connector with the outer surface of the body portion frictionally engaging the inner surface of the connector. The proximal end portion of the injection line is fixedly mounted within the opening of the connector with the proximal end of the injection line being coplanar with the inner surface of the connector and the passage of the injection line being aligned with the opening of the body portion of the injection nozzle.

The injection nozzle also includes upper and lower portions, with the body portion being disposed intermediate the upper and lower portions. At least one washer is disposed intermediate a shoulder of the upper portion of the injection nozzle and the connector.

The proximal end of the injection line and the inner surface of the connector are brazed to the outer surface of the body portion of the injection nozzle.

In a method for mounting a tubular injection line to an injection nozzle, the proximal end portion of the injection line is inserted into a transverse bore of a longitudinally extending connector until the proximal end of the injection line is proximate to the longitudinal axis of the connector. The injection line is them fixedly mounted to the connector. An axial bore is machined through the connector and the proximal end portion of the injection line forming a continuous inner surface which defines a cross-sectional shape which is complementary to the cross-sectional shape of the outer surface of the body portion of the injection nozzle. The lower portion of the injection nozzle is inserted through the axial bore until the body portion is positioned in the axial bore with the opening of the body portion aligned with the passage of the injection line. Then the connector is fixedly mounted to the injection nozzle.

When the connector is initially a solid longitudinally extending rod, the step of machining comprises machining a circular axial bore from the first end of the rod to the second end of the rod. The connector may be a cylinder where the circular axial bore has an inner diameter which is smaller than the outer diameter of the body portion. In this case, the step of machining comprises enlarging the diameter of the axial bore to substantially the same diameter as the outer diameter of the body portion.

If the transverse bore of the connector includes a shoulder, the step of inserting the injection line comprises pressing the proximal end portion of the injection line through the transverse bore until the proximal end engages shoulder.

The step of fixedly mounting the injection line comprises brazing the injection line to the connector. The step of fixedly mounting the connector comprises brazing the proximal end of the injection line and the inner surface of the connector to the outer surface of the body portion.

It is an object of the invention to provide a fuel injection system having fewer components and fewer connections than conventional fuel injection systems.

It is also an object of the invention to provide a fuel injection system having reduced engine cylinder head space requirements.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

With reference to the drawings wherein like numerals represent like parts throughout the several figures, an integrated injection line and injection nozzle in accordance with the present invention is generally designated by the numeral 10.

Figure 1:
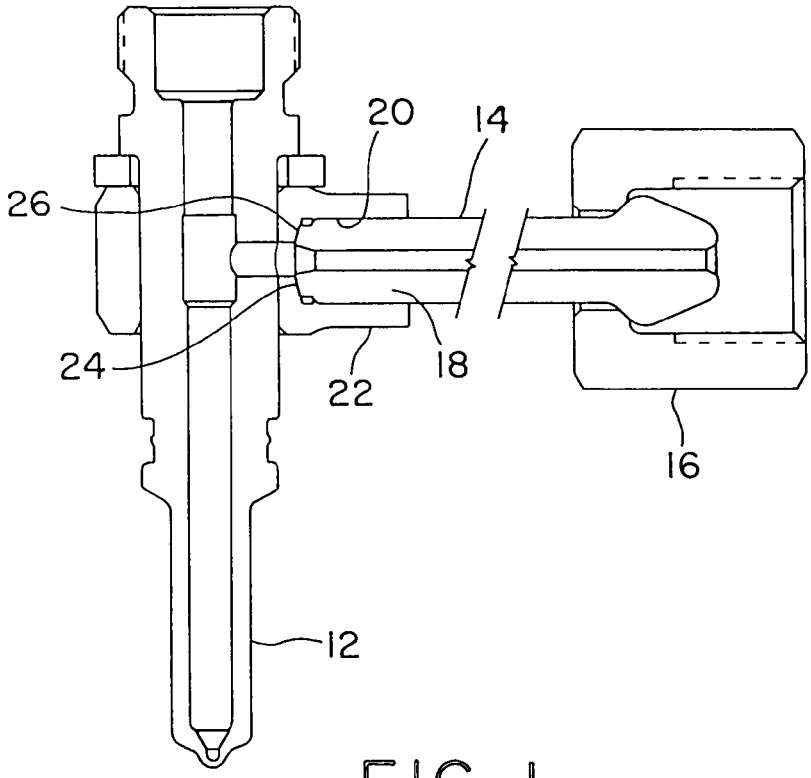
FIG. 1 PRIOR ART
FIG. 1 is a cross-sectional view of a prior art integrated injection line and nozzle.
Figure 2:
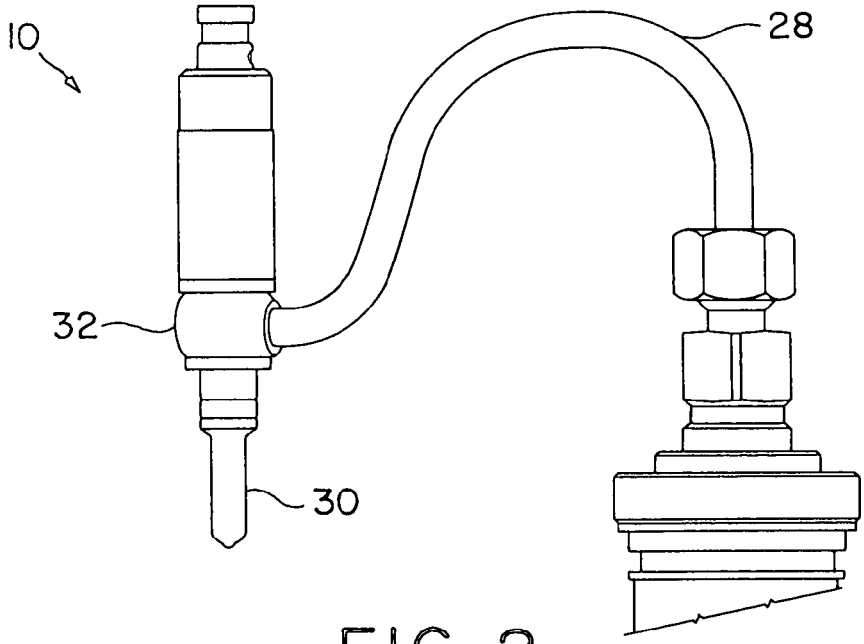
FIG. 2 is an elevational view of an upper portion of an injection pump and an integrated injection line and nozzle in accordance with the invention.
Figure 3:
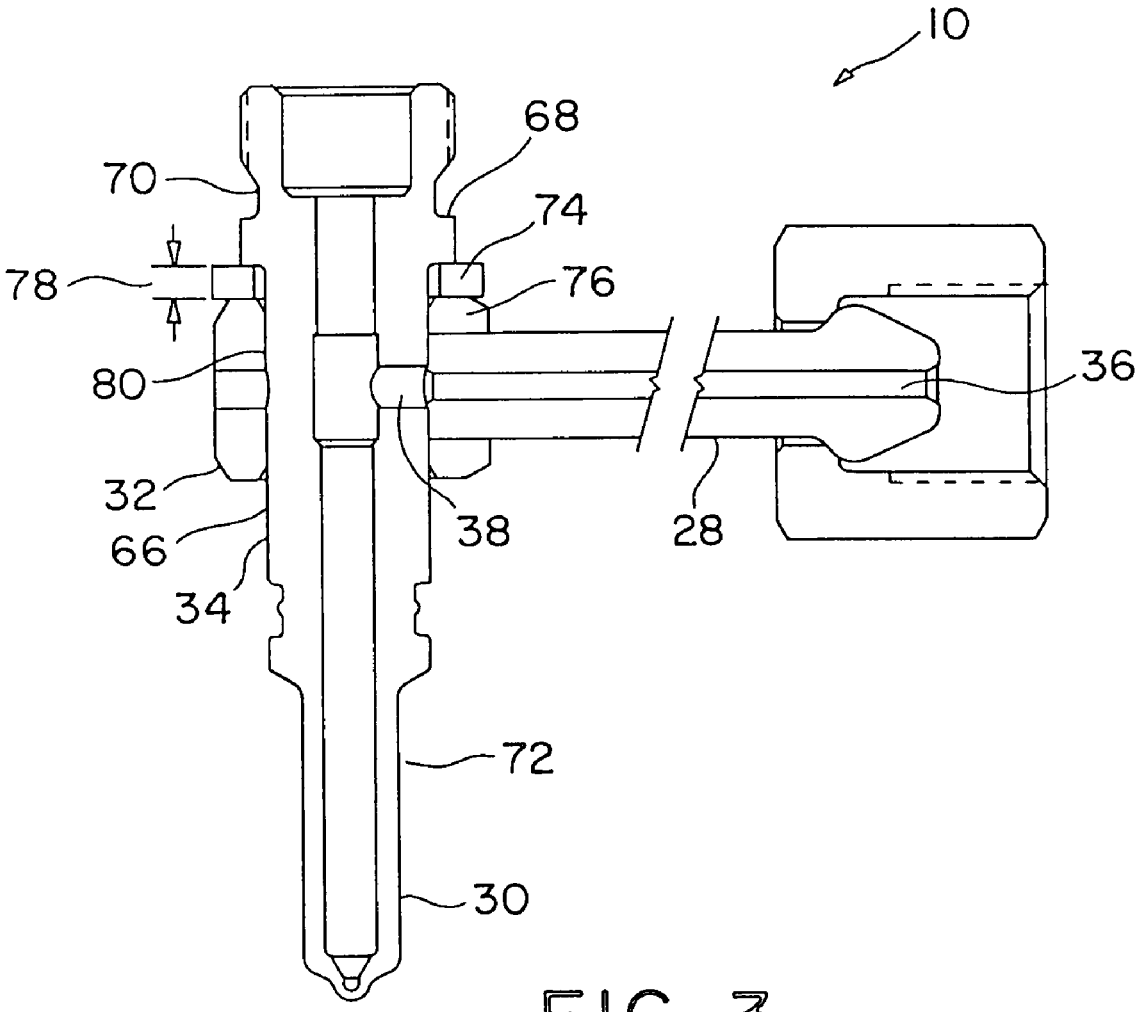
FIG. 3 is a cross-sectional view of the integrated injection line and nozzle of FIG. 2.

In most conventional vehicle fuel injection systems, the injection pump, injection nozzle 12 and injection line 14 are separate components, with the injection line 14 connecting the top portion of the injection pump to the top portion of the injection nozzle 12. The connection between the injection line 14 and both the injection nozzle 12 and the injection pump was affected by a nut 16 /threaded cylinder type of connection. Previous attempts to change the configuration of the connection between the nozzle 12 and the line 14 have been generally unsuccessful. In one such attempt, illustrated in FIG. 1, the proximal end portion 18 of the injection line 14 was pressed into an opening 20 in a connector 22 until the proximal end 24 of the line 14 contacted an inner shoulder 26 of the connector 22. The injection line 14 was then brazed to the connector 22. It was discovered that the inner shoulder 26 was incapable of withstanding high injection pressures, allowing a fatigue crack to form and propagate up the braze joint between the line 14 and connector 22 and ultimately resulting in failure of the connection.

In an integrated injection line and nozzle 10 in accordance with the invention, the injection line 28 is mounted to the injection nozzle 30 by a cylindrical connector 32 which encircles the nozzle body 34. The axial passage 36 in the line 28 is aligned with an inlet hole 38 in the body 34 when the connector/injection line assembly 40 is installed on the injection nozzle 30, as explained further below.

Figure 4A:
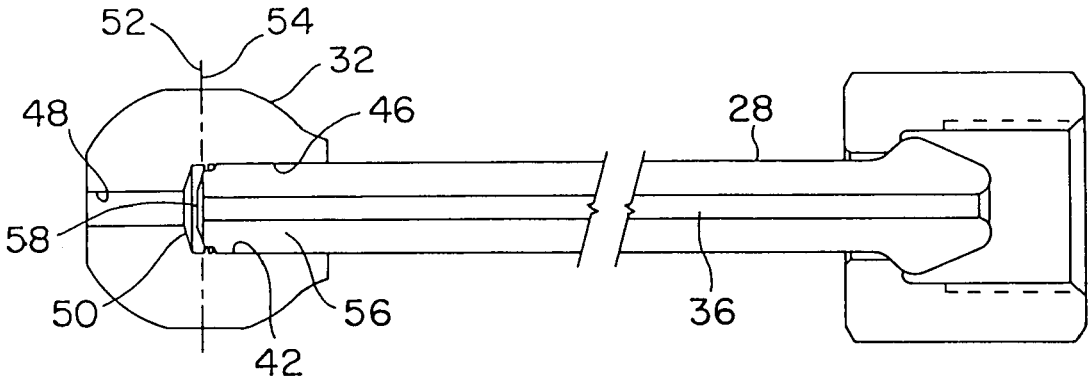
FIGS. 4*a* and 4*b* are cross-sectional views illustrating the injection line and the connector of FIG. 2, with FIG. 4*a* showing the assembly after brazing of the injection line to the connector and FIG. 4*b* showing the assembly after machining of the center bore.

Preferably, the connector 32 is initially a solid rod having a circular opening 42 extending transversely there through (FIG. 4*a*). Alternatively, the connector 32 may be a cylinder having an axial bore of a diameter which is smaller than the final diameter 44, as explained below. Opening 42 includes first and second portions 46, 48, with the diameter of the first portion 46 being greater than the diameter of the second portion 48, thereby defining a shoulder 50. Preferably, the shoulder 50 defines a plane 52 extending along the axis 54 of the connector 32. Alternatively, a recess having a circular cross-section may transversely to an end defining a plane extending along the axis of the connector.

Figure 4B:
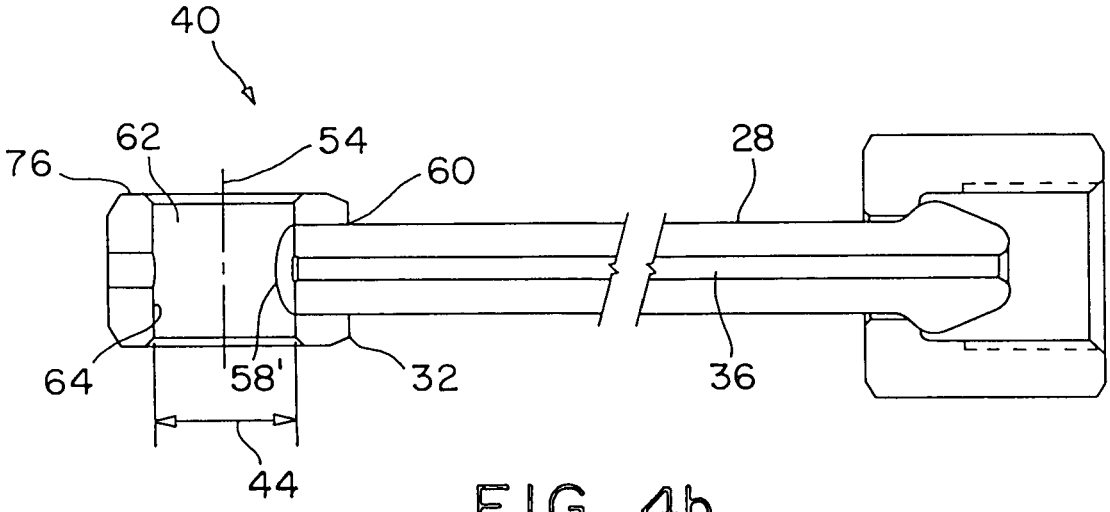

The connector 32 and injection line 28 are assembled by pressing the proximal end portion 56 of the injection line 28 through the first portion 46 of the opening 42 of the connector 32 until the proximal end 58 engages shoulder 50 (FIG. 4*a*). The injection line 28 is then brazed 60 to the connector 32. After brazing, an axial bore 62 is machined through the connector 32 and the proximal end portion 56 of the injection line 28 (FIG. 4*b*). This creates a cylinder having a continuous inner surface 64 (with the exception of the axial passage 36 of the injection line 28) that includes the proximal end 58' of the injection line 28 (as formed by the machining operation). The inside diameter 44 of the bore 62 is selected to provide a tight press-fit between the inner surface 64 of the connector 32 and the outer surface 66 of the nozzle body 34. If the connector 32 is initially a cylinder, the machining operation produces a final inside diameter 44 which provides a tight press-fit between the connector 32 and the nozzle body 34. It should be appreciated that bore 62 and outer surface 66 may have any complementary shape (in cross-section) providing a tight press-fit connection therebetween.

A radially extending shoulder 68 is formed on the upper portion 70 of the nozzle 30. The lower portion 72 of the nozzle 30 is inserted through one or more circular washers or shims 74 and is then pressed through the bore 62 of the connector/line assembly 40 until washers/shims 74 are clamped between the shoulder 68 of the nozzle 30 and the upper edge 76 of the connector 32. The total thickness 78 of the washers/shims 74 are selected such that the axial passage 36 in the line 28 is aligned with the inlet hole 38 in the body 34 when the washers/shims 74 are clamped between shoulder 68 and upper edge 76. The proximal end 58' of the injection line 28 and the inner surface 64 of the connector 32 are then brazed 80 to the outer surface 66 of the nozzle body 34. In this way no pipe/connector joint is exposed to injection pressure.

The integral injector/injection pipe 10 eliminates the need for space for the nut connection on one end of a typical injection pipe. The side entry allows the injector inlet to be routed more directly to the pump, thereby minimizing space and length requirements of typical injection pipe with typical top inlet injectors. Side entry also eliminates the need for internal fuel passages in the injection nozzle body, thereby providing reduced manufacturing costs and increased injector inlet/body joint structural integrity. Since internal fuel passages are not required, the side entry fuel inlet also allows a reduced overall injector diameter profile and simplified injector body processing because the fuel entering the injector is routed through the center of the injector body in one centrally located drilled hole. Injectors with top inlets are larger to allow enough body wall strength because multiple fuel duct drillings must located in the outer body wall on the outside of the spring chamber in the body.

It should be appreciated that the subject invention integrates the injection line 28 with the injection nozzle 30, thereby reducing the number of fuel injection system components by one component for each engine cylinder. Integration of the two components 28, 30 does not reduce the efficiency of the injection nozzle 30 or otherwise interfere with its operation. It should also be appreciated that the integrated injection nozzle and injection line 10 provides improved fuel injection system reliability by eliminating one potential leak source for each engine cylinder.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An integrated injection line and nozzle for a vehicle fuel injection system comprising:

a tubular injection line having oppositely disposed proximal and distal ends, a proximal end portion, and a passage extending from the proximal end to the distal end;

a sleeve-shaped connector including oppositely disposed inner and outer surfaces and an opening extending from the inner surface to the outer surface, the inner surface defining a cross-sectional shape; and an injection nozzle including a longitudinal bore and a body portion having an outer surface and an opening extending from the longitudinal bore to the outer surface, the outer surface defining a cross-sectional shape which is complementary to the cross-sectional shape of the inner surface of the connector;

wherein the body portion of the nozzle is disposed within the connector, the outer surface of the body portion frictionally engaging the inner surface of the connector and the proximal end portion of the injection line is fixedly mounted within the opening of the connector, the proximal end of the injection line being coplanar with the inner surface of the connector and the passage of the injection line being aligned with the opening of the body portion of the injection nozzle.

2. The integrated injection line and nozzle of claim 1 wherein the bore of the injection nozzle defines a nozzle axis and the proximal end portion of the injection line defines an injection line axis, the injection line axis being substantially perpendicular to the nozzle axis.

3. The integrated injection line and nozzle of claim 1 wherein the injection nozzle also includes upper and lower portions, the body portion being disposed intermediate the upper and lower portions, the upper portion defining a shoulder extending radially outward from the outer surface.

4. The integrated injection line and nozzle of claim 3 further including at least one shim disposed intermediate the shoulder of the upper portion of the injection nozzle and the connector.

5. The integrated injection line and nozzle of claim 1 wherein the proximal end of the injection line and the inner surface of the connector are brazed to the outer surface of the body portion of the injection nozzle.

6. A method for mounting a tubular injection line to an injection nozzle, the injection line having oppositely disposed proximal and distal ends, a proximal end portion, and a passage extending from the proximal end to the distal end, the injection nozzle having a longitudinal bore, upper and lower portions, and a body portion disposed intermediate the upper and lower portions, the body portion having an outer surface and an opening extending from the longitudinal bore to the outer surface, the outer surface of the body portion having a cross-sectional shape, the method comprising the steps of:

inserting the proximal end portion of the injection line into a transverse bore of longitudinally extending connector until the proximal end of the injection line is proximate to the longitudinal axis of the connector;

fixedly mounting the injection line to the connector;

machining an axial bore through the connector and the proximal end portion of the injection line forming a continuous inner surface defining a cross-sectional shape which is complementary to the cross-sectional shape of the outer surface of the body portion of the injection nozzle;

inserting the lower portion of the injection nozzle through the axial bore until the body portion is positioned in the axial bore with the opening of the body portion aligned with the passage of the injection line; and fixedly mounting the connector to the injection nozzle.

7. The method of claim 6 wherein the outer surface of the body portion has a substantially circular cross-sectional shape, the connector is a solid longitudinally extending rod having oppositely disposed first and second ends, and the step of machining comprises machining a circular axial bore from the first end to the second end.

8. The method of claim 6 wherein the outer surface of the body portion has a substantially circular cross-sectional shape having an outer diameter, the connector is a cylinder having a circular axial bore having an inner diameter which is smaller than the outer diameter of the body portion, and the step of machining comprises enlarging the diameter of the axial bore to substantially the same diameter as the outer diameter of the body portion.

9. The method of claim 6 wherein the transverse bore of the connector includes first and second portions, each of the portions having a diameter, the diameter of the first portion being greater than the diameter of the second portion, thereby defining a shoulder, the step of inserting the proximal end of the injection line comprising pressing the proximal end portion of the injection line through the first portion of the transverse bore of the connector until the proximal end engages shoulder.

10. The method of claim 6 wherein the step of fixedly mounting the injection line comprises brazing the injection line to the connector.

11. The method of claim 6 wherein the step of fixedly mounting the connector comprises brazing the proximal end of the injection line and the inner surface of the connector to the outer surface of the body portion.

12. The method of claim 6 wherein the upper portion of the injection nozzle defines a radially extending shoulder and the step of inserting the lower portion of the injection nozzle includes inserting the lower portion of the injection nozzle through at least one circular shim and inserting the lower portion of the injection nozzle through the axial bore until the at least one circular shim is clamped between the shoulder of the nozzle and the connector.

* * * * *